US009611116B2

(12) United States Patent
Sasaki et al.

(10) Patent No.: US 9,611,116 B2
(45) Date of Patent: Apr. 4, 2017

(54) MEDIUM TRANSPORT DEVICE

(71) Applicant: SEIKO EPSON CORPORATION, Tokyo (JP)

(72) Inventors: Tsuneyuki Sasaki, Matsumoto (JP); Yasuo Naramatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 228 days.

(21) Appl. No.: 14/150,328

(22) Filed: Jan. 8, 2014

(65) Prior Publication Data

US 2014/0197267 A1 Jul. 17, 2014

(30) Foreign Application Priority Data

Jan. 15, 2013 (JP) ..... 2013-004305

(51) Int. Cl.

| | |
|---|---|
| ***B65H 23/188*** | (2006.01) |
| *B65H 23/032* | (2006.01) |
| *B65H 18/10* | (2006.01) |

(52) U.S. Cl.

CPC ..... *B65H 23/1882* (2013.01); *B65H 18/103* (2013.01); *B65H 23/032* (2013.01); *B65H 2301/12* (2013.01); *B65H 2404/693* (2013.01); *B65H 2801/12* (2013.01)

(58) Field of Classification Search

CPC ..... B65H 23/06; B65H 23/10; B65H 23/105; B65H 23/14; B65H 23/1882; B65H 2404/693; B65H 23/032

See application file for complete search history.

(56) References Cited

U.S. PATENT DOCUMENTS 5,764,264 A * 6/1998 Takanaka ..... B41J 2/01 242/562

6,343,424 B1 2/2002 Erkelenz

FOREIGN PATENT DOCUMENTS

| | | |
|---|---|---|
| JP | 04-270672 | 9/1992 |
| JP | 08-174928 | 7/1996 |
| JP | 2003-128313 | 5/2003 |
| JP | 2004-107021 | 4/2004 |
| JP | 2008-189436 | 8/2008 |

OTHER PUBLICATIONS

European Search Report for European patent application No. 14151088.3 dated Jun. 5, 2014.

* cited by examiner

*Primary Examiner* — Michael McCullough
(74) *Attorney, Agent, or Firm* — Workman Nydegger

(57) ABSTRACT

A medium transport device is provided. The medium transport device includes a transporting portion that transports a medium in a transport direction, a winding portion that winds the medium, and a friction member that suppresses displacement of the medium in a cross direction with the transport direction. The displacement in the cross direction is suppressed by causing the friction member to contact the medium. A contact state of the medium with the friction member is changed in accordance with a winding mode in which the medium transported by the transporting portion is wound around the winding portion, and a non-winding mode in which the medium transported by the transporting portion is not wound around the winding portion.

5 Claims, 7 Drawing Sheets

MEDIUM TRANSPORT DEVICE

The present application claims priority to Japanese Patent Application No. 2013-004305 filed on Jan. 15, 2013, which application is hereby incorporated by reference in its entirety.

BACKGROUND

1. Technical Field

Embodiments of the present invention relate to a medium transport device.

2. Related Art

A medium transport device that has a transporting portion for transporting a medium in a transport direction and a winding portion for winding the medium is well known. A liquid discharging apparatus such as an ink jet printer is an example of a medium transport device. In an ink jet printer, the medium on which liquid is discharged is transported.

JP-A-2004-107021 is an example of the related art.

A certain type of the above-described medium transport device has two types of operation modes. The operation modes include a winding mode in which the medium transported by the transporting portion is wound around a winding portion and a non-winding mode in which the medium transported by the transporting portion is not wound around the winding portion. In conventional devices, however, it is possible that the transport of the medium is hindered.

SUMMARY

An advantage of some aspects of embodiments of the invention is that a medium is appropriately transported by a medium transport device.

In one embodiment, a medium transport device is provided and methods of transport are provided. The medium transport device may include a transporting portion that transports a medium in a transport direction, a winding portion that winds the medium, and a friction member that suppresses displacement of the medium in a cross or transverse direction with the transport direction. The friction member suppresses displacement of the medium by coming into contact with the medium.

The medium transport device can perform or operate in both a winding mode in which the medium transported by the transporting portion is wound around the winding portion, and a non-winding mode in which the medium transported by the transporting portion is not wound around the winding portion. In the medium transport device, a contact state of the medium with the friction member is changed in accordance with the winding mode and the non-winding mode. In the contact state, the medium is in contact with the friction member. Because the friction member exerts a frictional force, lateral displacement of the medium is suppressed by the friction member.

Other aspects of embodiments of the invention will be apparent from this specification and the accompanying drawings.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
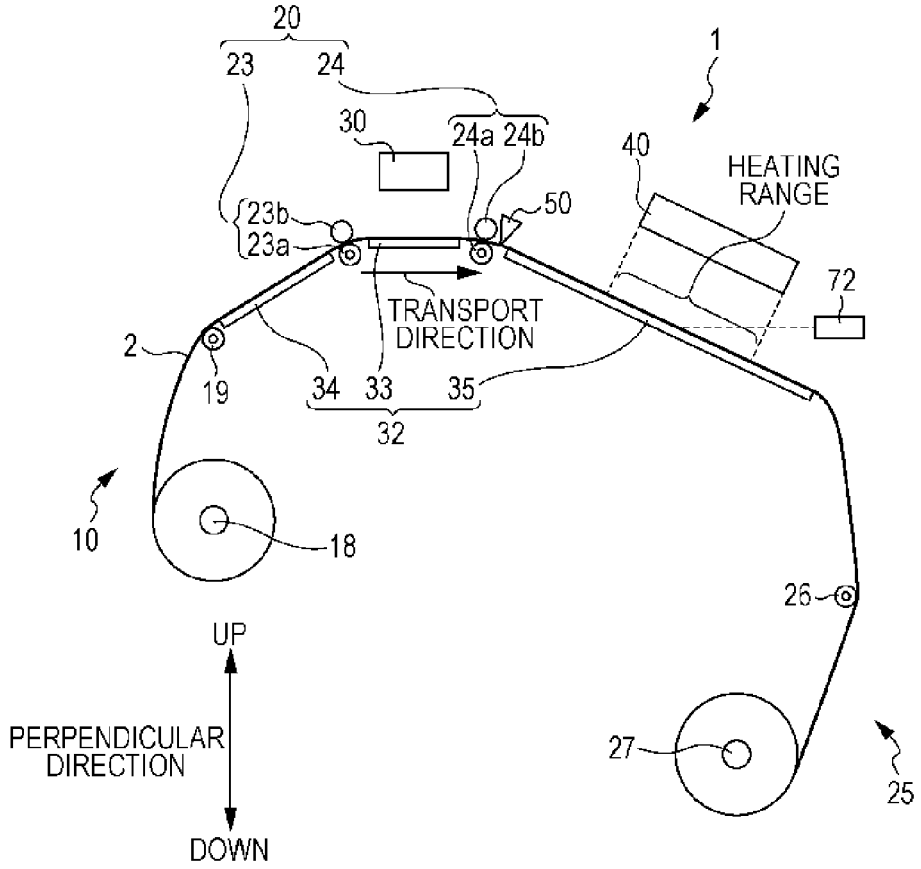
FIG. 1 is a schematic view showing a configuration example of a medium transport device such as a printer.

Embodiments of the invention relate to a medium transport device apparatus and methods of operating the apparatus or methods for transporting a medium in a medium transport device. More specifically, embodiments of the invention further relate to systems and methods for transporting a medium in a medium transport device that operates in at least a winding mode and a non-winding mode.

In one example, a medium transport device includes a transporting portion that transports a medium in a transport direction, a winding portion that winds the medium, and a friction member that suppresses displacement of the medium in a cross direction with the transport direction by coming into contact with the medium. The medium transport device operates in both a winding mode in which the medium transported by the transporting portion is wound around the winding portion, and a non-winding mode in which the medium transported by the transporting portion is not wound around the winding portion. A contact state of the medium with the friction member is changed in accordance with the winding mode and the non-winding mode.

Embodiments of the medium transport device appropriately transport the medium.

In addition, the medium transport device includes a winding mode transport path. The winding mode transport path of the medium is the path of the medium in the winding mode. The friction member may be disposed in the winding mode transport path.

In this case, it is possible to appropriately transport the medium by a simple method.

In addition, a medium support portion that supports the transported medium may be provided. When the non-winding mode is switched to the winding mode, an orientation of the medium support portion is changed to a direction or position that allows the medium to be introduced to the friction member.

In this case, it is possible to bring the medium into contact with the friction member when the medium transport device is operating in the winding mode.

In addition, a common transport path which is a transport path of the medium in both the winding mode and the non-winding mode may be provided. The friction member may also be provided in the common transport path when the medium transport device is in the winding mode. Thus, the friction member can be placed at different locations in the transport path of the medium transport device.

In this case, it is possible to appropriately transport the medium by a simple method.

In addition, the medium may be brought into contact with different friction members, in accordance with the winding mode and the non-winding mode. One friction member contacts the medium in the winding mode and a second friction member contacts the medium in the non-winding mode.

In addition, a medium support portion that supports the transported medium and a connection portion that rotatably supports the friction member with respect to the medium support portion may be provided. The medium comes into contact with the friction member in the winding mode in this example by rotating the friction member to an orientation where the friction member contacts the medium in the winding mode.

In this case, it is possible to appropriately transport the medium by a simple method.

Furthermore, a medium transport method is provided. In the method of transporting the medium, the medium is transported in the transport direction, a winding mode of transporting the medium with winding of the medium and a non-winding mode of transporting the medium without winding of the medium can be performed, and a contact state of the medium with the friction member can be changed in accordance with the winding mode and the non-winding mode. In other words, the method may include transporting the medium in a transport direction, transporting the medium in a winding mode while winding the medium and transporting the medium in a non-winding mode without winding the medium, and changing a contact state between the medium and the friction member in accordance with the winding mode and the non-winding mode.

According to this medium transport method, it is possible to appropriately transport the medium.

Schematic Configuration Example of a Medium Transport Device

Figure 2:
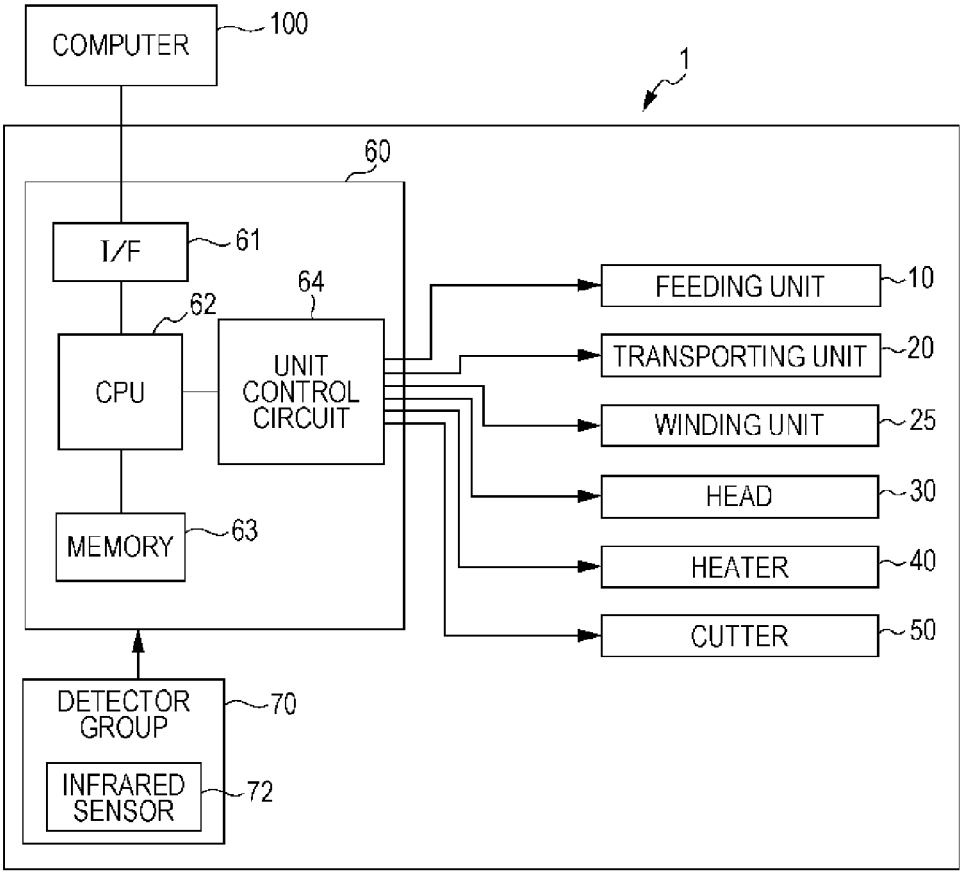
FIG. 2 is a block diagram of the configuration of the medium transport device.

FIG. 1 is a schematic view showing an example configuration of a medium transport device such as an ink jet printer (referred to as a printer 1, hereinafter. FIG. 2 is a block diagram of an example configuration of the printer 1.

As illustrated in FIGS. 1 and 2, the printer 1, in one embodiment, may include a feeding unit 10, a transporting unit 20, a winding unit 25 a head 30, a roll-shaped medium support body 32, a heater 40, a cutter 50, a controller 60, and a detector group 70. The transporting unit 20 is an example of a transporting portion and the winding unit 25 is an example of a winding portion.

The roll-shaped medium 2 is an example of a medium. The feeding unit 10 is configured to feed the roll-shaped medium 2 to the transporting unit 20. The medium unwinds as the medium is fed to the transporting unit 20. This feeding unit 10 has a roll-shaped medium winding shaft 18 around which the roll-shaped medium 2 is wound. The shaft 18 rotatably supports the roll-shaped medium 2. A relay roller 19 around which the roll-shaped medium 2 is unwound from the roll-shaped medium winding shaft 18 introduces the roll-shaped medium 2 to the transporting unit 20 is shown in FIG. 1. The relay roller 19 receives the medium from the roll-shaped medium 2 when the roll-shaped medium is unwound.

The transporting unit 20 is configured to transport the roll-shaped medium 2, which is sent by the feeding unit 10, along a pre-set transport path in a transport direction. The transporting unit 20 has a first transport roller 23 and a second transport roller 24. The transport roller 24 is positioned on a downstream side in the transport direction when seen from the first transport roller 23, as shown in FIG. 1. The first transport roller 23 has a first driving roller 23*a* which is driven by a motor (not shown) and a first driven roller 23*b* which is disposed to be opposite the first driving roller 23*a*. The roll-shaped medium 2 is interposed between the driven roller 23*b* and the driving roller 23*a*. Similarly, the second transport roller 24 has a second driving roller 24*a* which is driven by a motor (not shown) and a second driven roller 24*b* which is disposed to be opposite the second driving roller 24*a* with the roll-shaped medium 2 interposed therebetween.

The winding unit 25 is configured to wind the roll-shaped medium 2 (image-recorded roll-shaped medium 2) sent by the transporting unit 20. This winding unit 25 includes a relay roller 26 around which the roll-shaped medium 2 sent from the second transport roller 24 is wound and which transports the roll-shaped medium 2 on a downstream side in the transport direction. The winding unit 25 includes a roll-shaped medium winding drive shaft 27 which is rotatably supported and around which the roll-shaped medium 2 sent from the relay roller 26 is wound, as shown in FIG. 1. The relay roller 26 is upstream of the shaft 27.

The head 30 is configured to record (print) an image on part of the roll-shaped medium 2 that is positioned within an image recording area in the transport path. The roll-shaped medium 2 is sent to a position on a platen 33 by the transporting unit 20 and the head 30 forms an image on the roll-shaped medium 2 by causing an ink discharge nozzle to discharge ink (an example of a liquid) as shown in FIG. 1 to the portion of the roll-shaped medium in the recording area.

Furthermore, a piezoelectric element is provided in the ink discharge nozzle. The piezoelectric element is a driver element for discharging ink droplets. When a voltage with a predetermined time range is applied to electrodes provided on both ends of the piezoelectric element, the piezoelectric element extends or deforms in accordance with the time during which the voltage is applied and deforms a side wall of an ink flow passage. Due to the expansion/contraction of the piezoelectric element, a volume of the ink flow passage contracts in accordance with the expansion and contraction of the piezoelectric element, and thus the amount of the ink corresponding to the shrunk or decreased volume of the ink flow passage is discharged through the ink discharge nozzle as an ink droplet.

The roll-shaped medium support body 32 is configured for supporting the roll-shaped medium 2 from below. The roll-shaped medium support body 32 may be formed of a metal material (e.g., aluminum). In one embodiment, the platen 33 may be included in the support body and is opposite the head 30. An upstream side support member 34 is positioned on the upstream side of the platen 33 in the transport direction, and a downstream side support member 35 (corresponding to the medium support portion) is positioned on the downstream side of the platen 33 in the transport direction. The upstream side support member 34 and the downstream side support member 35 are provided as the roll-shaped medium support body 32, as shown in FIG. 1.

The heater 40 is configured for curing the ink by heating the roll-shaped medium 2 (more specifically, heating the ink on the roll-shaped medium 2). The heater 40 may be an infrared heater emitting infrared rays and the heater 40 is provided at a position opposite the downstream side support member 35, as shown in FIG. 1. The heater 40 heats the roll-shaped medium 2 supported by the downstream side support member 35.

The cutter 50 is configured for cutting the roll-shaped medium 2. When in the non-winding mode, the cutter 50 cuts the roll-shaped medium 2 and separates the image-recorded roll-shaped medium 2 from the portion of the roll-shaped medium 2 where no image has been recorded. This cutter 50 may be provided between the head 30 and the heater 40 in the transport direction, as shown in FIG. 1.

In addition, the printer 1 includes the controller 60. The controller 60 is configured to control the units described above and the like and manages operations of the printer 1, and of the detector group 70, as shown in FIG. 2. When a print command (print data) from a computer 100 or an external device is received, the printer 1 causes the controller 60 to control each unit (the feeding unit 10, the transporting unit 20, the winding unit 25, the head 30, the heater 40, and the cutter 50). The controller 60 controls each unit and prints the image on the roll-shaped medium 2 based on the print data received from the computer 100 or other device or system. An inner state of the printer 1 is monitored by the detector group 70, and the detector group 70 outputs detection results to the controller 60. The controller 60 controls each unit based on the detection results output from the detector group 70 in one example.

Furthermore, an infrared sensor 72 may be provided in the printer 1 as one of components constituting the detector group 70, as shown in FIGS. 1 and 2. This infrared sensor 72 detects infrared ray energy by sensing a surface of the roll-shaped medium 2, which is within a heating range (in other words, an emitting range) (see FIG. 1) of the heater 40. Subsequently, the controller 60 controls energy emitted from the heater 40, based on the energy detected by the infrared sensor 72.

The controller 60 is a control unit (e.g., a control portion) that controls the printer 1. The controller 60 has an interface portion 61, a CPU 62, a memory 63, and a unit control portion 64. The interface portion 61 carries out data transmission and reception between the computer 100 of an external device or other external device and the printer 1. The CPU 62 is an example of a processor-controller for controlling the entire printer 1. The memory 63 is used for ensuring a storage area and a working area of programs for the CPU 62. In other words, programs executable by the CPU 62 are stored in the memory 63. The memory 63 has storage elements such as RAM, which is a volatile memory, and EEPROM, which is a non-volatile memory. The CPU 62 controls each unit via the unit control portion 64, based on the programs stored in the memory 63.

Execution Modes of Printer 1

Figure 3:
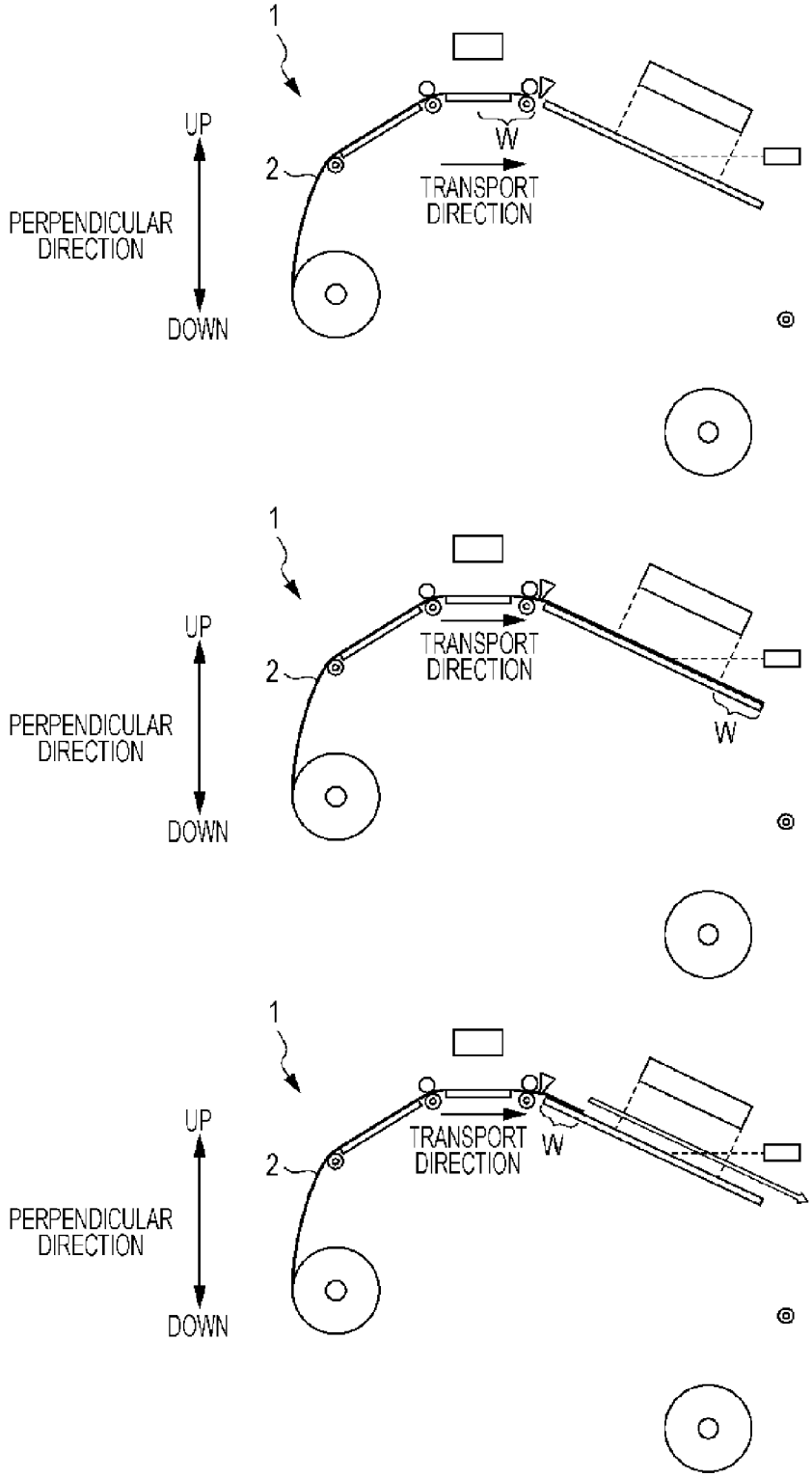
FIG. 3 is an explanatory view for illustrating a non-winding mode of the medium transport device.

Next, a winding mode and a non-winding mode, which are execution or operation modes of the printer 1, will be described with reference to FIGS. 1 and 3. FIG. 3 is an explanatory view for explaining a non-winding mode. In addition, the winding mode will be described with reference to FIG. 1, because a winding mode execution state is illustrated in FIG. 1.

The printer 1 illustrated in FIG. 1 includes the non-winding mode and the winding mode as execution or operation modes. In the non-winding mode, the winding unit 25 is not used and the image-recorded roll-shaped medium 2 is not wound by the roll-shaped medium winding drive shaft 27. In the winding mode, the winding unit 25 is used and the image-recorded roll-shaped medium 2 is wound by the roll-shaped medium winding drive shaft 27. More specifically, the controller 60 performs the winding mode in which the roll-shaped medium 2 transported by the transporting unit 20 is wound around the winding unit 25. The controller 60 also performs the non-winding mode in which the roll-shaped medium 2 transported by the transporting unit 20 is not wound around the winding unit 25. In other words, the controller 60 of the printer 1 can perform the winding mode and the non-winding mode and can switch between the winding mode and the non-winding mode. Furthermore, the execution and switching of the modes are performed by the control portion. In addition, a user may manually switch the operation of the printer 1 between the winding mode and the non-winding mode.

When in the winding mode, the roll-shaped medium 2 is transported by the transporting unit 20 in a state where the roll-shaped medium 2 is wound around both the feeding unit 10 and the winding unit 25 (the roll-shaped medium winding shaft 18 and the roll-shaped medium winding drive shaft 27), as shown in FIG. 1.

The roll-shaped medium 2 is unwound from the shaft 18 and proceeds through a transport path. Subsequently, part of the roll-shaped medium 2, which is unwound from the roll-shaped medium winding shaft 18, reaches a position opposite the head 30. The image is then formed on the part of the roll-shaped medium 2 at the position opposite the head 30. Next, the roll-shaped medium 2 is further transported, and the image formed part then reaches a position opposite the heater 40. Infrared rays are irradiated on the image formed part at the position opposite the heater 40. Next, the roll-shaped medium 2 is further transported, and the image formed part reaches the winding unit 25 and is wound by the roll-shaped medium winding drive shaft 27.

In contrast, when in the non-winding mode, the roll-shaped medium 2 is transported, by the transporting unit 20, in a state where the roll-shaped medium 2 is wound around only the feeding unit 10, as shown in FIG. 3.

Subsequently, part of the roll-shaped medium 2, which is unwound from the roll-shaped medium winding shaft 18, reaches the position opposite the head 30. The image is formed on the part (an example of an image forming range on the roll-shaped medium 2 is shown by reference symbol W in FIG. 3) of the roll-shaped medium 2 at the position opposite the head 30 (an image formed state is shown in the top drawing of FIG. 3). In other words, FIG. 3 illustrates that an image may be formed on the portion W of the roll-shaped medium 2 and that the portion W is subsequently transported in the transport direction.

The roll-shaped medium 2 is further transported, and thus the image forming range W reaches the position opposite the heater 40. Infrared rays are irradiated on the image forming range W at the position opposite the heater 40. A state where irradiation of infrared rays on the image forming range W is complete is shown in a middle drawing of FIG. 3. After the irradiation has been completed, the image forming range W is no longer opposite the heater 40.

After the image forming range W has been irradiated, the roll-shaped medium 2 is transported in a reverse direction (e.g., subjected to back feed) by the transporting unit 20. Therefore, the image forming range W returns to be immediately to a front of the cutter 50 and the roll-shaped medium 2 is cut by the cutter 50 (see the bottom drawing of FIG. 3). In this example, when the cutter 50 cuts the roll-shaped medium 2, the image forming range W is downstream of the cutter 50. Accordingly, the image-recorded roll-shaped medium 2 is separated from the image-unrecorded roll-shaped medium 2 and moves (is discharged) in the direction of the long white arrow by sliding on the downstream side support member 35 as illustrated in the bottom drawing of FIG. 3.

Figure 4:
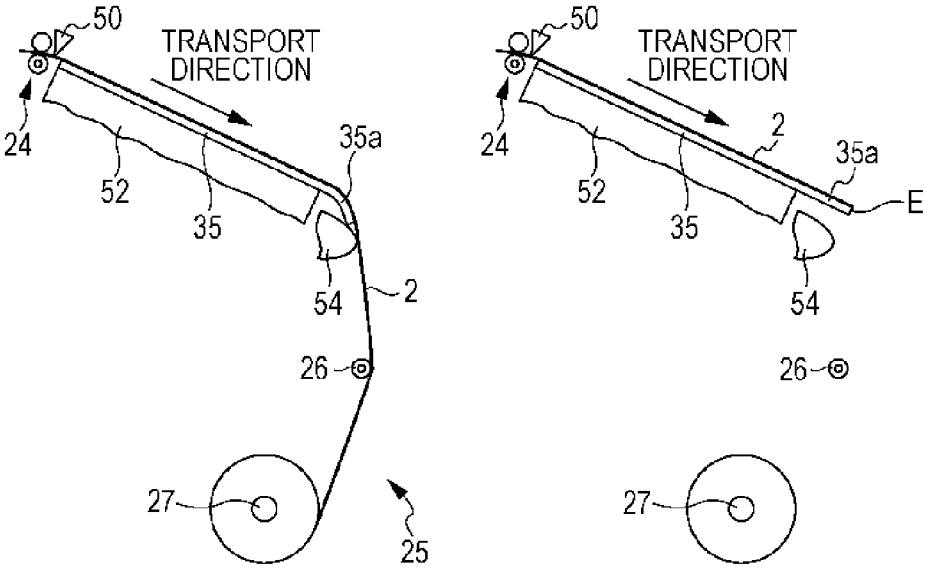
FIG. 4 is a schematic cross-sectional view showing an example of a configuration of a downstream side support member and a peripheral portion thereof.

Configuration of a Downstream Side Support Member 35 and Peripheral Portion Thereof Next, a configuration of the downstream side support member 35 and a peripheral portion thereof will be described with reference to FIG. 4. FIG. 4 is a schematic cross-sectional view showing an example of the configuration of the downstream side support member 35 and the peripheral portion thereof. Furthermore, a left drawing of FIG. 4 shows a state of the downstream side support member 35 and peripheral portion thereof when in the winding mode, and a right drawing of FIG. 4 shows a state of the downstream side support member 35 and peripheral portion thereof when in the non-winding mode. In addition, the cross section of the downstream side support member 35 is also shown in FIG. 1. However, the drawing illustrated in FIG. 1 further schematically shows the configuration of the downstream side support member 35 illustrated in FIG. 4.

As described above, the downstream side support member 35 is provided on the downstream side of the platen 33 in the transport direction and the downstream side support member is one of the components constituting the roll-shaped medium support body 32. In one embodiment, the downstream side support member 35 includes a thin metal plate of 0.5 mm or about 0.5 mm in thickness.

In addition, an underpinning portion 52 which supports the downstream side support member 35 from below is provided below the downstream side support member 35. The underpinning portion 52 supports part of the downstream side support member 35, except a tip portion 35*a* thereof in the transport direction, as shown in FIG. 4.

In addition, a friction member 54 is provided on the downstream side of the underpinning portion 52 in the transport direction and below the downstream side support member 35. The friction member 54 is a member formed of an elastomer in one example. The friction member 54 exerts a function of suppressing displacement (e.g., lateral displacement) of the roll-shaped medium 2 in a figure direction (a width direction of the medium), that is, a cross or transverse direction with respect to the transport direction by being in contact with the roll-shaped medium 2. In other words, the friction member 54 suppresses the movement of the roll-shaped medium 2 in the figure direction (the width direction of the medium), with a friction force which is generated when the friction member 54 comes into contact with the roll-shaped medium 2.

Furthermore, in one embodiment, the entire member shown by reference numeral 54 in FIG. 4 is the friction member 54 (the member formed of the elastomer). Alternatively, only a part of the member shown by reference numeral 54 which comes into contact with the roll-shaped medium 2 may be the friction member 54 (the member formed of the elastomer).

As previously mentioned, the printer 1 includes the cutter 50. The cutter 50 may operate not only in the winding mode, which is a normal mode, but also the non-winding mode, as described above. However, a contact state of the roll-shaped medium 2 with the friction member 54 is changed in accordance with the winding mode and the non-winding mode. In one embodiment, the roll-shaped medium 2 comes into contact with the friction member 54 when in the winding mode, and the roll-shaped medium 2 does not come into contact with the friction member 54 when in the non-winding mode. In this example, the contact state between the roll-shaped medium 2 and the friction member 54 can change based on the mode in which the printer 1 is operating.

The reason for this will be described. When in the winding mode, the roll-shaped medium 2 transported by the transporting unit 20 is wound by the winding unit 25. Thus, the roll-shaped medium 2 is transported by transport forces acting thereon. The transport forces include a transport force (a winding force) which is generated by the winding unit 25, along with a transport force which is generated by the transporting unit 20.

In contrast, when in the non-winding mode, the roll-shaped medium 2 transported by the transporting unit 20 is not wound by the winding unit 25. In other words, the roll-shaped medium 2 is not connected with the winding unit 25, and thus a tip edge E of the roll-shaped medium 2 in the transport direction is held in a free state, as shown in right drawing in FIG. 4. Thus, the roll-shaped medium 2 is transported with only the transport force, which is generated by the transporting unit 20, acting thereon. Therefore, when in the non-winding mode, the transport force (in other words, ease of movement of the roll-shaped medium 2) is smaller than the transport force in the winding mode. Accordingly, there is a possibility that the roll-shaped medium 2 may be caught (e.g., supported) on the friction member 54 if the medium 2 were to come into contact with the friction member 54 in the non-winding mode. This contact between the medium 2 and the friction member 53 in the non-winding mode may hinder the transport of the roll-shaped medium 2 in the non-winding mode.

For these reasons, the roll-shaped medium 2 is brought into contact with the friction member 54 only when in the winding mode. That is, when in the winding mode, the roll-shaped medium 2 is brought into contact with the friction member 54 because it is useful to suppress the lateral displacement of the roll-shaped medium 2 in the transport path. Further, when in the non-winding mode, the roll-shaped medium 2 is not brought into contact with the friction member 54 or is prevented from contacting the friction member 54 because it may be of more importance (more than the importance of suppressing the lateral displacement) to suppress or prevent the roll-shaped medium 2 from being caught on the friction member 54.

In addition, the transport path of the roll-shaped medium 2 is extended when in the winding mode in comparison with the non-winding mode. A longer transport path is subject to more factors that can cause lateral displacement of the medium on the transport path. Thus, the longer the transport path is, the larger the number of factors (in other words, the number of positional spots causing the lateral displacement) causing the lateral displacement of the roll-shaped medium 2 becomes. Thus, from this point of view, it may be useful to give more importance to suppressing the lateral displacement of the medium 2 when in the winding mode. In contrast, when in the non-winding mode, it may be useful to give more importance to suppressing the roll-shaped medium 2 from being caught on the friction member 54, because the lateral displacement of the medium 2 hardly occurs.

Next, example operations for bringing the friction member 54 into contact with the roll-shaped medium 2 when in the winding mode and having the friction member 54 not be in contact with the roll-shaped medium 2 when in the non-winding mode will be described.

By comparing the left drawing and the right drawing of FIG. 4, an orientation of the downstream side support member 35 (specifically, the tip portion 35*a*) is changed in accordance with the winding mode and the non-winding mode.

That is, the downstream side support member 35 is not bent when in the non-winding mode, and thus the roll-shaped medium 2 does not come into contact with the friction member 54 positioned below the downstream side support member 35. Thus, the downstream side support member 35 may be separated from the friction member 54, as shown in the right drawing of FIG. 4. Furthermore, when the non-winding mode is switched to the winding mode, the downstream side support member 35 (e.g., the tip 35*a*) is pressed downward by the roll-shaped medium 2 to which tension is applied by the winding unit 25 and the like. As a result, the orientation of the downstream side support member 35 (e.g., the tip portion 35*a*) is changed to a direction in which the roll-shaped medium 2 is introduced to the friction member 54, as shown in the left drawing of FIG. 4. That is, the downstream side support member 35 (the tip portion 35*a*) is pressed downward by the roll-shaped medium 2, and thus the orientation thereof is changed to a direction in which the roll-shaped medium 2 is brought into contact with the friction member 54.

In other words, in a case where the non-winding mode is switched to the winding mode, when the orientation of the downstream side support member 35 (the tip portion 35*a*) is changed, the transport path of the roll-shaped medium 2 is changed. In one example, the transport path that is constituted by an upper portion of the tip portion 35*a* in a mode changed state and a path further on a downstream side of the transport direction than the upper portion of the tip portion 35*a* is called a transport path (e.g., a winding mode transport path). In contrast, a transport path that is constituted by a path further on an upstream side of the transport direction than the upper portion of the tip portion 35*a* is a common transport path. The common transport path is commonly used in both modes. The roll-shaped medium 2 passes when only the winding mode out of both modes is performed is the winding mode transport path. In other words, the winding mode transport path, which is a medium transport path when the printer 1 is in the winding mode, and the common transport path, which is a medium transport path in the winding mode and the non-winding mode, are present. In this case, it is possible to bring the roll-shaped medium 2 into contact with the friction member 54 only when in the winding mode, because the friction member 54 is provided in the winding mode transport path. In this example, the friction member 54 is not provided in the common transport path.

Effectiveness of Printer 1

As described above, the printer 1 may include the transporting unit 20 that transports the roll-shaped medium 2 in the transport direction, the winding unit 25 that winds the roll-shaped medium 2, and the friction member 54 that suppresses the roll-shaped medium 2 from being displaced in the figure direction (the width direction of the medium or direction transverse to the transport direction) by being in contact with the roll-shaped medium 2. The friction member 54, when in contact with the medium 2, can suppress lateral displacement of the medium during transport. Further the printer 1 performs the winding mode is when the roll-shaped medium 2 transported by the transporting unit 20 is wound around the winding unit 25 and performs the non-winding mode is when the roll-shaped medium 2 transported by the transporting unit 20 is not wound around the winding unit 25. In addition, in the printer 1, the contact state of the roll-shaped medium 2 with the friction member 54 is changed in accordance with the winding mode and the non-winding mode. For example, the friction member 54 may contact the medium 2 in the winding mode and may not contact the medium 2 in the non-winding mode.

Therefore, as described above, it is possible to give more importance to suppressing the lateral displacement of the medium 2 when in the winding mode and to give more importance to suppressing the roll-shaped medium 2 from being caught on the friction member 54 when in the non-winding mode. Thus, it is possible to appropriately transport the roll-shaped medium 2 and it is possible to appropriately transport the medium 2 in both modes.

In addition, in one embodiment, the winding mode transport path is a path through which the roll-shaped medium 2 is transported in the winding mode and the friction member 54 is provided in the winding mode transport path.

Therefore, the contact state is changed in accordance with the winding mode and the non-winding mode, and thus it is possible to appropriately transport the roll-shaped medium 2 with a simple method.

Furthermore, the printer 1 includes the downstream side support member 35. The downstream side support member 35 supports the transported roll-shaped medium 2 and the orientation of the downstream side support member 35 is capable of changing. For example, the orientation of the downstream side support member 35 changes to the direction in which the roll-shaped medium 2 is introduced to the friction member 54 when the non-winding mode is switched to the winding mode. In other words, the orientation of the downstream side support member 35 changes (e.g., the tip 35*a* bends) such that the medium 2 is brought into contact with the friction member 54 when the printer 1 switches from the non-winding mode to the winding mode.

Thus, it is possible to appropriately bring the roll-shaped medium 2 into contact with the friction member 54 when in the winding mode and to suppress or prevent lateral displacement of the medium 2.

Other Embodiments

Embodiments of the medium transport device are disclosed herein. In addition, a medium transport method and the like are also disclosed. The foregoing discussion facilitate an understanding of embodiments of the invention, and is not intended to be construed as limiting the invention. Needless to say, embodiments of the invention can be changed or modified and include the equivalents thereof, insofar as they are within the scope of embodiments of the invention. Particularly, aspects of embodiments of the invention are further described below.

In one example, the medium transport device may be an ink jet printer as discussed previously. However, without being limited thereto, any device can be used as long as the device has a medium transport function.

For example, a liquid ejecting apparatus that ejects or discharges liquid aside from ink may also be used instead of the ink jet printer and may be an example of a medium transport apparatus. Furthermore, various types of liquid ejecting apparatuses that are equipped with a liquid ejecting head or the like ejecting a small amount of a liquid droplet can be adopted. In addition, the liquid droplet means the state of the liquid which is ejected from the liquid ejecting apparatus and includes, by way of example and not limitation, granule forms, teardrop forms, and forms that pull trails in a string-like form therebehind.

In addition, the liquid referred to herein can be any material capable of being ejected by the liquid ejecting apparatus. For example, any matter can be used as long as the matter is in its liquid phase, including liquids having high or low viscosity, sol, gel water, other inorganic solvents, organic solvents, liquid solutions, liquid resins, and fluid states such as liquid metals (metallic melts). Furthermore, in addition to liquids as a single state of a matter, liquids in which the particles of a functional material composed of a solid matter such as pigments, metal particles, or the like are dissolved, dispersed, or mixed in a liquid carrier are included as well. Ink, a liquid crystal or the like is exemplified as a representative example of a liquid in the embodiments described above. In this case, the ink includes a general water-based ink and an oil-based ink, in addition to various liquid compositions of a gel ink, a hot melt ink or the like. A liquid ejecting apparatus which ejects liquid containing material such as an electrode material or a coloring material in a dispersed or dissolved state, which is used for manufacturing a liquid crystal display, an electroluminescence (EL) display, a surface-emitting display, a color filter or the like is exemplified as a specific example of the liquid ejecting apparatus. In addition, the liquid ejecting apparatus may be a liquid ejecting apparatus for ejecting a living organic material used for manufacturing a biochip, a liquid ejecting apparatus for ejecting a liquid as a sample used as a precision pipette, printing equipment, a micro dispenser or the like. Further, the liquid ejecting apparatus may be a liquid ejecting apparatus for precisely ejecting lubricant into a precision machine such as a watch or a camera, or a liquid ejecting apparatus that ejects onto a substrate a transparent resin liquid such as an ultraviolet curing resin in order to form a minute hemispherical lens (e.g., an optical lens) used in an optical communication element or the like. In addition, the liquid ejecting apparatus may be a liquid ejecting apparatus that ejects an etching liquid such as acid or alkali to etch a substrate or the like. In addition, any one of these ejecting apparatuses can be adopted in embodiments of the invention.

Furthermore, in one embodiment, the transporting unit 20 includes the first transport roller 23, which is positioned further on an upstream side of the transport direction than the head 30, and the second transport roller 24, which is positioned further on a downstream side of the transport direction than the head 30. Thus, the first transport roller 23 is upstream of the head 30 and the transport roller 24 is downstream of the head 30. However, the number of or the arrangement of the transport rollers is not limited thereto.

In addition, in one embodiment, the roll-shaped medium 2 comes into contact with the friction member 54 when in the winding mode and the roll-shaped medium 2 does not come into contact with the friction member 54 when in the non-winding mode. This is an example of operating modes in which the contact state of the roll-shaped medium 2 with the friction member 54 is changed in accordance with the winding mode and the non-winding mode. However, a configuration of the printer 1 or of the downstream support member 35 is not limited thereto. For example, a configuration (referred to as a first modification example) shown in FIG. 5 may also be adopted.

Figure 5:
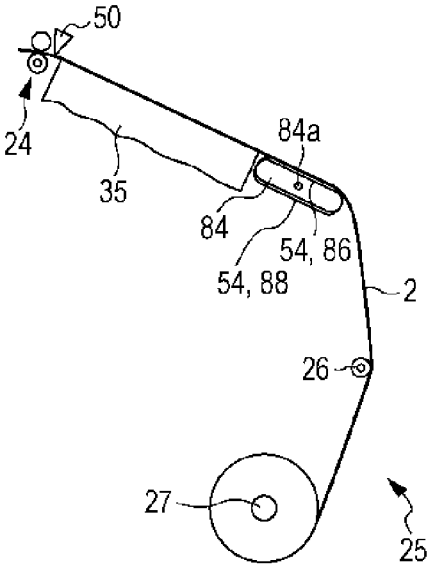
FIG. 5 is a schematic cross-sectional view showing another example of a configuration of a downstream side support member and a peripheral portion thereof

In FIG. 5, a rotary member 84 rotatable about a central axis 84*a* is provided on the downstream side of the downstream side support member 35 in the transport direction. Furthermore, two different types of sheet-shaped friction members 54 are affixed on surfaces of the rotary member 84. The two types of friction members may have different friction coefficients and are provided on the surfaces of the rotary member 84. That is, a first friction member 86 and a second friction member 88 are provided. The friction coefficient (the static friction coefficient and the kinetic friction coefficient) with respect to the roll-shaped medium 2 of the second friction member 88 is smaller than the friction coefficient of the first friction member 86. The first friction member 86 and the second friction member 88 are provided on the surfaces of the rotary member 84 such that both friction members 54 are located at point-symmetric positions about the central axis 84*a*. In addition, the rotary member 84 rotates. When in the winding mode, the first friction member 86 is positioned on the side (the side where the friction member comes into contact with the roll-shaped medium 2) of the roll-shaped medium 2 and the second friction member 88 is positioned on the side opposite the roll-shaped medium 2 (see FIG. 5). Further, when in the non-winding mode, the second friction member 88 is positioned on the side (the side where the friction member comes into contact with the roll-shaped medium 2) of the roll-shaped medium 2 and the first friction member 86 is positioned on the opposite side to the roll-shaped medium 2. Furthermore, the rotary member 84 according to the embodiment also supports the roll-shaped medium 2, in cooperation with the downstream side support member 35. By rotating the rotary member 84, the first friction member 86 can be placed directly underneath the medium 2 during the winding mode or the second member 88 can be placed directly underneath the medium 2 during the non-winding mode.

Advantageously, in the first modification example, the roll-shaped medium 2 comes into contact with different friction members 54 in accordance with the winding mode and the non-winding mode, as described above. Therefore, it is possible to give more importance to suppressing the lateral displacement when in the winding mode. Also, it is possible to give more importance to suppressing the roll-shaped medium 2 from being caught on the friction member 54, while maintaining the lateral displacement suppression function, when in the non-winding mode. Thus, it is possible to more appropriately transport the roll-shaped medium 2.

In addition, in the first modification example, two types of friction members 54 are provided. As a result, the friction force is changed in accordance with the winding mode and the non-winding mode. There may be more friction, for example, in the winding mode due to the higher friction coefficient.

However, an example in which the friction force is changed in accordance with both modes includes an example in which a pressing force of the roll-shaped medium 2 against the friction member 54 is changed in accordance with both modes (e.g., pressing with a large force when in the winding mode and pressing with a small force when in the non-winding mode), an example in which a contact area of the friction member 54 with the roll-shaped medium 2 is changed (e.g., the contact area is large when in the winding mode and the contact area is small when in the non-winding mode), or the like. In other words, the friction force can be changed by changing how hard the medium 2 is pressed against the friction member 54, changing the area of contact between the medium 2 and the friction member 54, or the like. Furthermore, any example described above may be adopted.

In addition, an example in which, only when in the winding mode, the friction member 54 is provided in the winding mode transport path through which the roll-shaped medium 2 passes is adopted in the embodiment described above, as an example in which the roll-shaped medium 2 comes into contact with the friction member 54 when in the winding mode and the roll-shaped medium 2 does not come into contact with the friction member 54 when in the non-winding mode. However, a configuration is not limited thereto. For example, as shown in second to fourth modification examples described below, the friction member 54 may be provided in the common transport path when only the winding mode, selected out of the winding mode and the non-winding mode, is performed. The friction member 54 may thus be configured such that the friction member 54 is provided in the common transport path only when winding.

Figure 6:
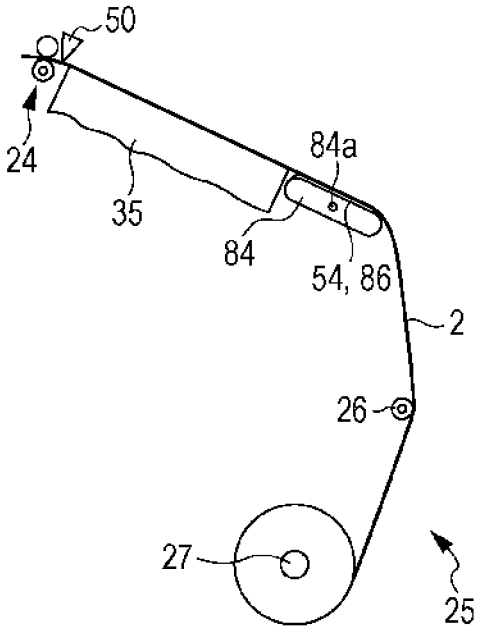
FIG. 6 is a schematic cross-sectional view showing another example of a configuration of a downstream side support member and a peripheral portion thereof.

In the second modification example, the rotary member 84 similar to that in the first modification example described in FIG. 5. As illustrated in FIG. 6, the rotary member is provided in the transport path. However, unlike the first modification example, only the first friction member 86 is affixed on the rotary member 84 and the second friction member 88 is not provided. Furthermore, in this example, it is possible to arrange the friction member 54 such that the friction member 54 is present in the common transport path only when in the winding mode. By rotating the rotary member 84 (see FIG. 6), the friction member 88 affixed to the rotary member 84 can be rotated into the common transport path and out of the common transport path. In addition, it is possible to cause the friction member 54 to retreat from the common transport path when in the non-winding mode, for example, by rotating the rotary member 84.

Figure 7:
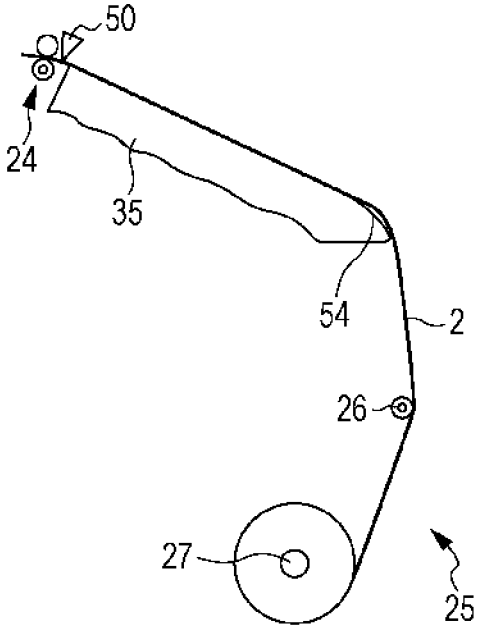
FIG. 7 is a schematic cross-sectional view showing another example of a configuration of a downstream side support member and a peripheral portion thereof.

In a third modification example, the sheet-shaped friction member 54 attachable to and detachable from the downstream side support member 35 is provided in the common transport path, as shown in FIG. 7. When in the winding mode, the friction member 54 is attached to the downstream side support member 35 by a user (see FIG. 7). Further, when in the non-winding mode, the friction member 54 is removed from the downstream side support member 35 by a user. Accordingly, the roll-shaped medium 2 comes into contact with the friction member 54 when in the winding mode, and the roll-shaped medium 2 does not come into contact with the friction member 54 when in the non-winding mode.

Figure 8:
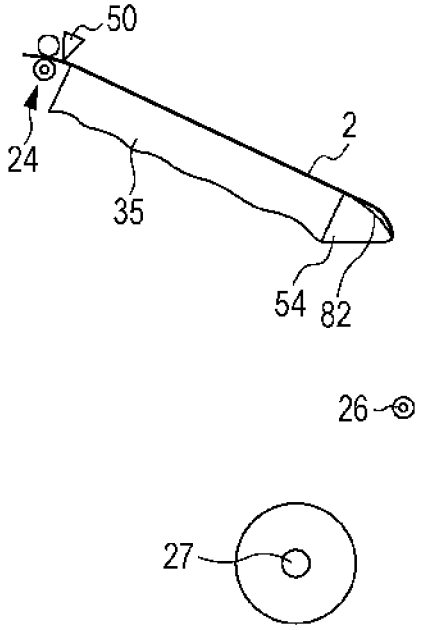
FIG. 8 is a schematic cross-sectional view showing another example of a configuration of a downstream side support member and a peripheral portion

In a fourth modification example, the friction member 54 is provided on the downstream side of the downstream side support member 35 in the transport direction and in the common transport path, as shown in FIG. 8. In addition, a cover member 82 attachable to and detachable from the friction member 54 is provided on the friction member 54. This cover member 82 covers the friction member 54 to prevent the friction member 54 from being exposed. When in the non-winding mode, the cover member 82 is installed on the downstream side support member 35 by a user (see FIG. 8), and when in the winding mode, the cover member 82 is removed from the downstream side support member 35 by a user. Accordingly, the roll-shaped medium 2 comes into contact with the friction member 54 when in the winding mode, and the roll-shaped medium 2 does not come into contact with the friction member 54 when in the non-winding mode.

As described above, if the friction member 54 is configured to be provided in the common transport path when only the winding mode is performed, is performed, it is possible to change the contact state, using a simple method, in accordance with the winding mode and the non-winding mode. Thus, it is possible to appropriately transport the roll-shaped medium 2. In other words, when selecting between the winding mode and the non-winding mode, it is possible to configure the friction member 54 in the common transport path such that the friction member 54 is only in the common transport path when performing or operating the winding mode.

Figure 9:
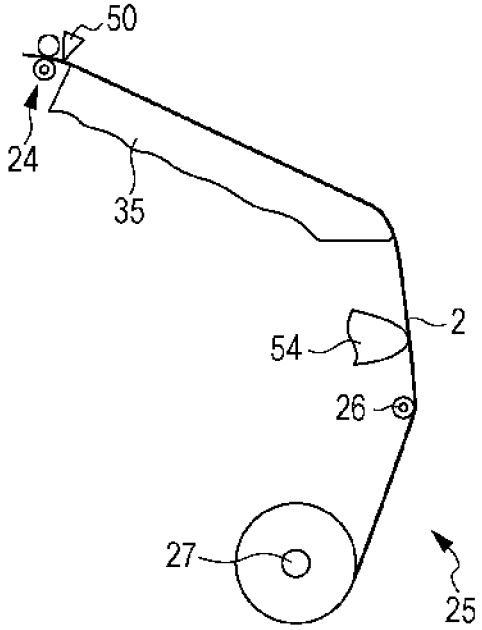
FIG. 9 is a schematic cross-sectional view showing another example of a configuration of a downstream side support member and a peripheral portion thereof.

In addition in an embodiment previously described, when the non-winding mode is switched to the winding mode, the orientation of the downstream side support member 35 is changed to the direction in which the roll-shaped medium 2 is introduced to the friction member 54. This embodiment is an example of providing the friction member 54 in the winding mode transport path through when the roll-shaped medium 2 passes when only the winding mode out of the winding mode and the non-winding mode is performed. That is, when the non-winding mode is switched to the winding mode, the transport path is changed (shifted) corresponding to the change of the orientation, and thus the friction member 54 is provided in the changed transport path. However, a configuration is not limited thereto. For example, an example (a fifth modification example) shown in FIG. 9 may also be adopted.

In the fifth modification example, the downstream side support member 35 is not a thin plate as shown in FIG. 4, and thus the orientation of the downstream side support member 35 is not changed. Accordingly, the transport path is not changed (shifted) when the modes are switched. However, upon comparison with the example shown in FIG. 4, the friction member 54 is provided on a more transport-direction downstream side (e.g., further downstream from the downstream side support member 35. Thus the friction member 54 is positioned within the winding mode transport path. An example in which the transport path is not shifted when the modes are switched, as described above, may also be adopted.

Figure 10:
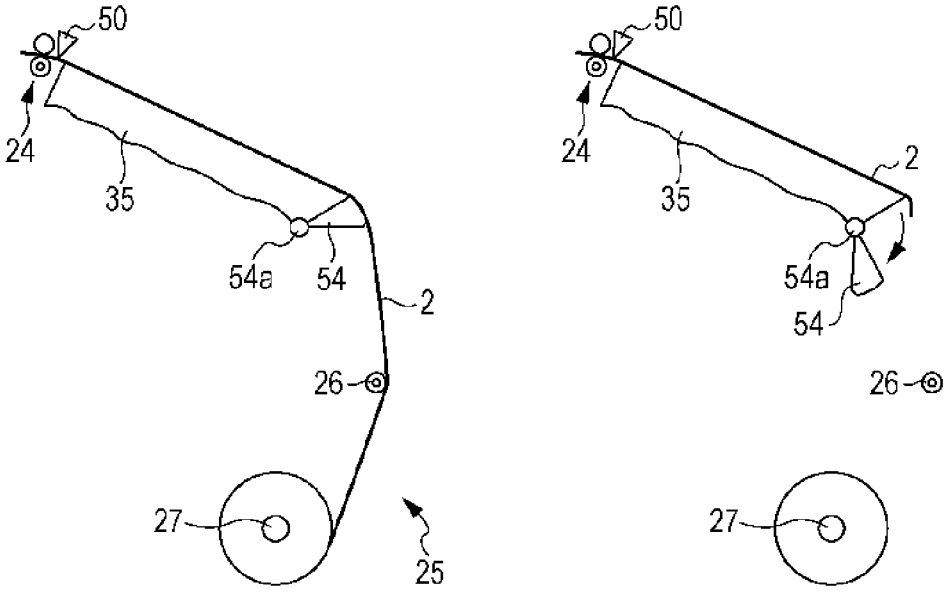
FIG. 10 is a schematic cross-sectional view showing another example of a configuration of a downstream side support member and a peripheral portion.

In a sixth modification example, the friction member 54 is provided on the downstream side of the downstream side support member 35 in the transport direction, as shown in FIG. 10. Furthermore, a left drawing of FIG. 10 shows a state when operating in the winding mode, and a right drawing of FIG. 10 shows a state when operating in the non-winding mode. The friction member 54 is connected to the downstream side support member 35 by a hinge portion 54*a* as a connection portion. Thus, the friction member 54 is supported by the downstream side support member 35, in a rotatable state about the hinge portion 54*a*. Thus the friction member 54 is configured to rotate to the transport path and out of the transport path. When in the non-winding mode, the friction member 54 rotates and retreats from the common transport path. Accordingly, the roll-shaped medium 2 comes into contact with the friction member 54 when in the winding mode and the roll-shaped medium 2 does not come into contact with the friction member 54 when in the non-winding mode. In addition, although the hinge portion 54*a* is used as a connection portion, any member may be used as a connection portion as long as it rotatably supports the friction member 54.

In the embodiments described above, although the roll-shaped medium 2 is exemplified as an example of a medium, a cut-form medium may also be adopted as a medium. In a case where a medium is a cut-form medium, the non-winding mode is performed. Accordingly, the cut-form medium is prevented from being caught by the friction member 54, and thus it is possible to appropriately transport the cut-form medium. Further, one of skill in the art can appreciate that the roll-shaped medium 2 is unwound and substantially flat during transport.

What is claimed is:

1. A medium transport device comprising:

a transporting portion that transports a medium in a transport direction;

a medium support portion that supports the transported medium in the transport direction by contacting an underside of the medium, the medium support portion having a movable tip portion at a downstream end in the transport direction;

a winding portion that winds the medium, wherein the tip portion is moveable based on tension applied when the winding portion winds the medium; and a friction member that is configured to come into contact with the medium and that is configured to suppress displacement of the medium in a direction that is transverse to the transport direction when the friction member comes into contact with the medium, the friction member being disposed adjacent to an end portion of the medium support portion in a downstream direction in the transport direction, the friction member coming into contact with the medium when the moveable tip portion comes into contact with the friction member, wherein a contact state of the medium with the friction member is changed in accordance with a winding mode in which the medium transported by the transporting portion is wound around the winding portion, and a non-winding mode in which the medium transported by the transporting portion is not wound around the winding portion, wherein the friction member and the winding member are downstream of a recording head that is configured to eject ink onto the medium.

2. The medium transport device according to claim 1, further comprising:

a winding mode transport path which is a transport path of the medium in the winding mode, wherein the friction member is provided in the winding mode transport path.

3. The medium transport device according to claim 1, further comprising:

a common transport path which is a transport path of the medium in both the winding mode and the non-winding mode, wherein, in the winding mode, the friction member is provided in the common transport path.

4. A medium transport method of a medium transport device that includes a medium support portion that supports a transported medium in a transport direction by contacting an underside of the medium, the medium support portion having a movable tip portion at a downstream end in the transport direction and a friction member configured to come into contact with the medium, the friction member being disposed adjacent to an end portion of the medium support portion in a downstream direction in the transport direction, the friction member coming into contact with the medium when the moveable tip portion comes into contact with the friction member, the method comprising:

transporting the medium in a winding mode while winding the medium with a winding portion; and transporting the medium in a non-winding mode without winding the medium with the winding portion, wherein a contact state of the medium with the friction member is changed in accordance with the transporting the medium in a winding mode and transporting the medium without winding the medium.

5. The medium transport method of claim 4, further comprising changing the contact state of the medium such that friction member contacts the medium in the winding mode and such that the friction member does not contact the medium in the non-winding mode.

* * * * *